US006164742A

United States Patent [19]

Hauck

[11] Patent Number: 6,164,742

[45] Date of Patent: Dec. 26, 2000

[54] ACTIVE ACCUMULATOR SYSTEM FOR AN INK-JET PEN

[75] Inventor: Mark Hauck, Corvallis, Oreg.

[73] Assignee: Hewlett-Packard Company, Palo Alto, Calif.

[21] Appl. No.: 08/308,035

[22] Filed: Sep. 14, 1994

[51] Int. Cl.[7] ..... B41J 2/195

[52] U.S. Cl. ..... 347/6; 347/85

[58] Field of Search ..... 347/85, 86, 87, 347/6, 94

[56] References Cited

U.S. PATENT DOCUMENTS

| | | | |
|---|---|---|---|
| 3,126,874 | 3/1964 | Exner . | |
| 4,476,472 | 10/1984 | Aiba et al. | 347/86 |
| 4,631,554 | 12/1986 | Terasawa . | |
| 4,728,004 | 3/1988 | Bonerb | 222/61 |
| 5,040,002 | 8/1991 | Pollacek et al. | 347/87 |
| 5,129,794 | 7/1992 | Beatty . | |
| 5,409,134 | 4/1995 | Cowger et al. | 347/87 |
| 5,446,486 | 8/1995 | Reis | 347/85 |
| 5,453,772 | 9/1995 | Aono et al. | 347/87 |

FOREIGN PATENT DOCUMENTS

| | | | |
|---|---|---|---|
| 567270 | 10/1993 | European Pat. Off. | 347/94 |
| 44666 | 4/1981 | Japan | 347/94 |
| 103877 | 6/1982 | Japan | 347/6 |
| 145155 | 8/1984 | Japan | 347/85 |
| 145156 | 8/1984 | Japan | 347/94 |
| 318760 | 12/1993 | Japan | 347/86 |

OTHER PUBLICATIONS

"Micron Machinations," *Scientific American*, Nov. 1992, pp. 105–114.

Wolffenbuttel et al., "Design Considerations for a Permanent–rotor–charge–excited Micromotor With an Electrostatic Bearing," *Sensors and Actuators A.*, Jan. 1991, pp. 583–590.

Matsumoto and Colgate, "Preliminary Investigation of Micropumping Based on Electrical Control of Interfacial Tension," *IEEE*, Apr. 1990, pp. 105–110.

Richter and Sandmaier, "An Electrohydrodynamic Micropump," *IEEE*, Apr. 1990, pp. 99–104.

Jerman, "Electrically–Activated, Micromachined Diaphragm Valves," *IEEE*, Sep. 1990, pp. 64–69.

Shoji Nakagawa and Esashi, "Micropump and Sample–injector for Integrated Chemical Analyzing Systems," *Sensors and Actuators*, A21–A23, Jan. 1990, pp. 189–192.

Guckel, Burns and Rutigliano, "Design and Construction Techniques for Planar Polysilicon Pressure Transducers With Piezoresistive Read–Out," Jan. 1986, 2 pages.

Fan, Tai and Muller, "Integrated Movable Micromechanical Structures for Sensors and Actuators," *IEEE Transactions on Electron Devices*, vol. 35, No. 6, Jun. 1988, 14 pages.

*Primary Examiner*—John Barlow
*Assistant Examiner*—Craig A. Hallacher

[57] ABSTRACT

The accumulator system includes minute pump and transducer mechanisms carried on the pen for regulating changes in the back pressure of the pen reservoir. One pump inflates a bag that is carried inside the reservoir. Another pump deflates the bag. The pumps are selectively controlled, in response to pressure changes detected by the transducer mechanism.

29 Claims, 6 Drawing Sheets

ACTIVE ACCUMULATOR SYSTEM FOR AN INK-JET PEN

TECHNICAL FIELD

The present invention is directed to a system for actively regulating the fluid pressure within the ink reservoir of an inkjet pen.

BACKGROUND INFORMATION

Ink-jet printing generally involves the controlled delivery of ink drops from an ink-jet pen reservoir to a printing surface. One type of ink-jet printing, known as drop-on-demand printing, employs a pen that has a print head that is responsive to control signals for ejecting drops of ink from the ink reservoir. Drop-on-demand type print heads typically use one of two mechanisms for ejecting drops: thermal bubble or piezoelectric pressure wave. A thermal bubble type print head includes a thin-film resistor that is heated to cause rapid vaporization of a small portion of the ink. The rapid expansion of the ink vapor forces a small amount of ink through a print head orifice.

Piezoelectric pressure wave type print heads use a piezoelectric element that is responsive to a control signal for abruptly compressing a volume of ink in the print head thereby to produce a pressure wave that forces the ink drops through the orifice.

Although conventional drop-on-demand print heads are effective for ejecting ink drops from a pen reservoir, they do not include any mechanism for preventing ink from permeating through the print head when the print head is inactive. Accordingly, drop-on-demand techniques require that the fluid in the ink reservoir be stored in a manner that provides a slight back pressure at the print head to prevent ink leakage from the pen whenever the print head is inactive. As used here, the term "back pressure" means the partial vacuum within the pen reservoir that resists the flow of ink through the print head. Back pressure is considered in the positive sense so that an increase in back pressure represents an increase in the partial vacuum. Accordingly, back pressure is measured in positive terms, such as water column height.

The back pressure at the print head must be at all times strong enough for preventing ink leakage. The back pressure, however, must not be so strong that the print head is unable to overcome the back pressure to eject ink drops. Moreover, the ink-jet pen must be designed to operate despite environmental changes that cause fluctuations in the ambient pressure or in back pressure. In this regard, the back pressure must be regulated.

An environmental change that calls for regulation of reservoir back pressure occurs during air transport of an ink-jet pen. In this instance, ambient air pressure decreases as the aircraft gains altitude and is depressurized. As ambient air pressure decreases, a correspondingly greater amount of back pressure is needed to keep ink from leaking through the print head. Accordingly, the level of back pressure within the pen must be increased during times of ambient pressure drop.

The back pressure within an inkjet pen reservoir is subjected to what may be termed "operational effects." One significant operational effect occurs as the print head is activated to eject ink drops. The consequent depletion of ink from the reservoir increases (makes more negative) the reservoir back pressure. Without regulation of this back pressure increase, the ink-jet pen will eventually fail because the print head will be unable to overcome the increased back pressure to eject ink drops.

Past efforts to regulate the pen reservoir back pressure in response to environmental changes and operational effects have included mechanisms that may be collectively referred to as accumulators.

Generally, prior accumulators comprise an elastomeric bladder or cup-like mechanism that defines a volume that is in fluid communication with the ink-jet pen reservoir volume. The accumulators of the past were of the passive type, designed to move between a minimum volume position and a maximum volume position in response to changes in the level of the back pressure within the reservoir. Accumulator movement changes the overall volume of the reservoir, hence regulating back pressure level changes so that the back pressure remains within an operating range that is suitable for preventing ink leakage while permitting the print head to continue ejecting ink drops.

For example, as the difference between ambient pressure and the back pressure within the pen decreases as a result of ambient air pressure drop, the accumulator moves to increase the reservoir volume. The volume increase effectively raises the back pressure to a level, within the range discussed above, that prevents ink leakage. Put another way, the increased volume attributable to accumulator movement prevents a decrease in the difference between ambient air pressure and back pressure that would otherwise occur if the reservoir were constrained to a fixed volume as ambient air pressure decreased.

Accumulators also move to decrease the reservoir volume whenever environmental changes or operational effects (for example, ink depletion occurring during operation of the pen) cause an increase in the back pressure. The decreased volume attributable to accumulator movement reduces the back pressure to a level within the operating range, thereby permitting the print head to continue ejecting ink.

Accumulators are usually equipped with internal or external resilient mechanisms that continuously urge the accumulators toward a position for increasing the volume of the reservoir. The effect of the resilient mechanisms is to retain a sufficient minimum back pressure within the reservoir (to prevent ink leakage) even as the accumulator moves to increase or decrease the reservoir volume.

Prior accumulator designs have suffered from at least two deficiencies. First, the working volume of the accumulator (that is, the maximum reservoir volume increase or decrease that is provided by the accumulator) was limited in size. Specifically, the working volume of the accumulator was limited to the maximum size of the bladder or similar structure that could be housed within the ink-jet pen. Accordingly, the environmental operating range of prior pens, which range may be quantified as the maximum ambient pressure drop the pen could sustain without leakage, was limited by the size of the working volume of the accumulator.

Similarly, the mechanisms associated with accumulators for changing the accumulator size usually limit the minimum volume to which the accumulator can move. For example, the thickness of an elastomeric-bladder accumulator may prevent the accumulator from obtaining a very small minimum volume. As a result, pen reservoir capacity for storing ink is lost in order to accommodate the minimum volume size of the accumulator.

SUMMARY OF THE INVENTION

The present invention is directed to an active accumulator system for an ink-jet pen that features minute pumping mechanisms that are operable for inflating and deflating a bag that is carried within the pen reservoir. The inflated volume of the bag may be controlled for the purpose of precisely regulating the back pressure in the reservoir. The bag employed with the present system may be constructed without the need for internal or external resilient mechanisms since the volume of the bladder is controlled by the pumping mechanisms. As a result, a very thin-walled bag may be employed. The inflatable bag provides a very large expanded or maximum accumulator volume and a very small contracted or minimum accumulator volume.

The pumping and sensing mechanisms employed with the present system may be constructed of micromachined components, thereby providing a very compact system. In a preferred embodiment, the pumping and sensing mechanisms are mounted to the wall of the pen and controlled by part of the circuitry that is also used for controlling the operation of the print head.

DESCRIPTION OF PREFERRED EMBODIMENTS

Figure 1:
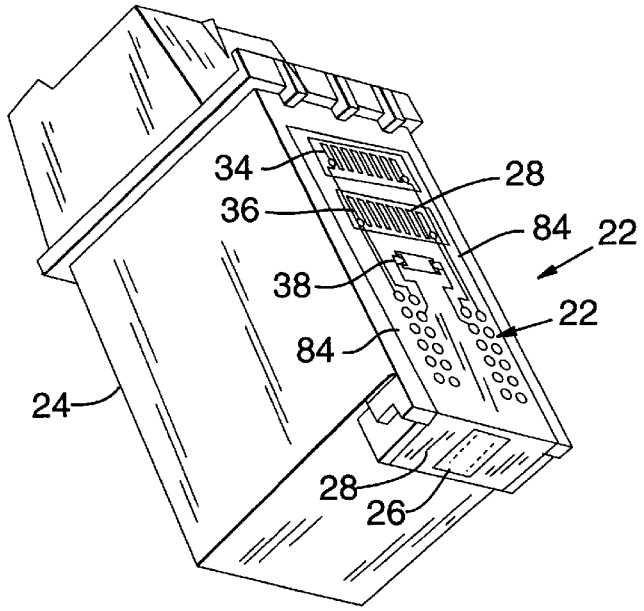
FIG. 1 is perspective view of an ink-jet printer pen that includes the accumulator system of the present invention.

The accumulator system of the present invention is mounted to an ink-jet pen 22 (FIG. 1). The body of the pen defines a reservoir 24 that is configured to hold a quantity of ink. A thermal-bubble type print head 26 is fit into the bottom 28 of the pen body and controlled for ejecting ink drops from the reservoir 24. The configuration of the reservoir walls and print head may be substantially as provided in the pen component of an ink-jet printer manufactured by Hewlett-Packard Company of Palo Alto, Calif., under the trademark DeskJet.

The accumulator system regulates the back pressure within the ink reservoir by controlling the volume of an inflatable bag 30 (FIG. 5) that is mounted for expansion and contraction inside the reservoir 24. The interior of the otherwise sealed bag is in fluid communication with pumps 34, 36 that are described more fully below. With the bag 30 in place, the reservoir is filled with ink at the time of manufacture of the pen. A slight back pressure (hereinafter referred to as the minimum back pressure) is established within the pen reservoir. The minimum back pressure is the minimum amount of back pressure necessary to keep ink from leaking through the print head 26 at ambient air pressure when the print head is inactive.

As the pen is used for printing, the air pressure in the reservoir 24 normally decreases (hence, the back pressure increases) as the stored volume of ink is depleted. The present system, however, provides an inflation pump 36 that is used to expand the bag, thereby decreasing the volume of the reservoir to maintain the reservoir back pressure within a range such that the print head is able to continue ejecting ink from the reservoir. If the ambient pressure should thereafter decrease (for example, during air transport of the pen), the deflation pump 34 will pump air from the bag 30 so that the bag will displace less volume in the reservoir. The consequent increase in the reservoir volume insures that the back pressure within the reservoir, relative to ambient, does not drop to a level that permits ink to leak from the print head.

Figure 8:
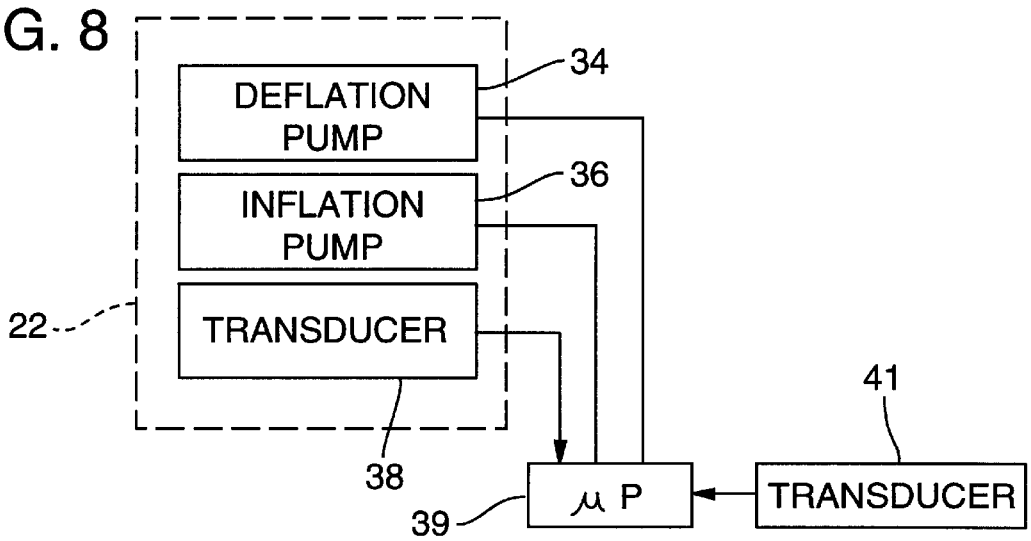
FIG. 8 is a diagram of the overall control system of the present accumulator system.

The back pressure within the reservoir is monitored by a pressure transducer 38 that is mounted to the pen and that provides a signal to the microprocessor 39 (FIG. 8) that controls the pen operation. The microprocessor 39 compares this signal with that received from an ambient air pressure transducer 41 to arrive at a pressure differential value. This value is checked against predetermined upper and lower limits. If either limit is exceeded, the appropriate inflation or deflation pump is operated by the microprocessor to return the back pressure to a level within the permissible limits.

Turning now to the particulars of a preferred embodiment of the accumulator system formed in accordance with the present invention, the bag 30 is formed of thin flexible layers. The outer layer comprises a film of polyethylene that is attached by a binder layer to one side of a thin "barrier" film of material, such as ethylene vinyl alcohol (EVOH). The other side of the barrier film is similarly lined with a thin layer of polyethylene. Any of a number of flexible-bag constructions will suffice.

Figure 3:
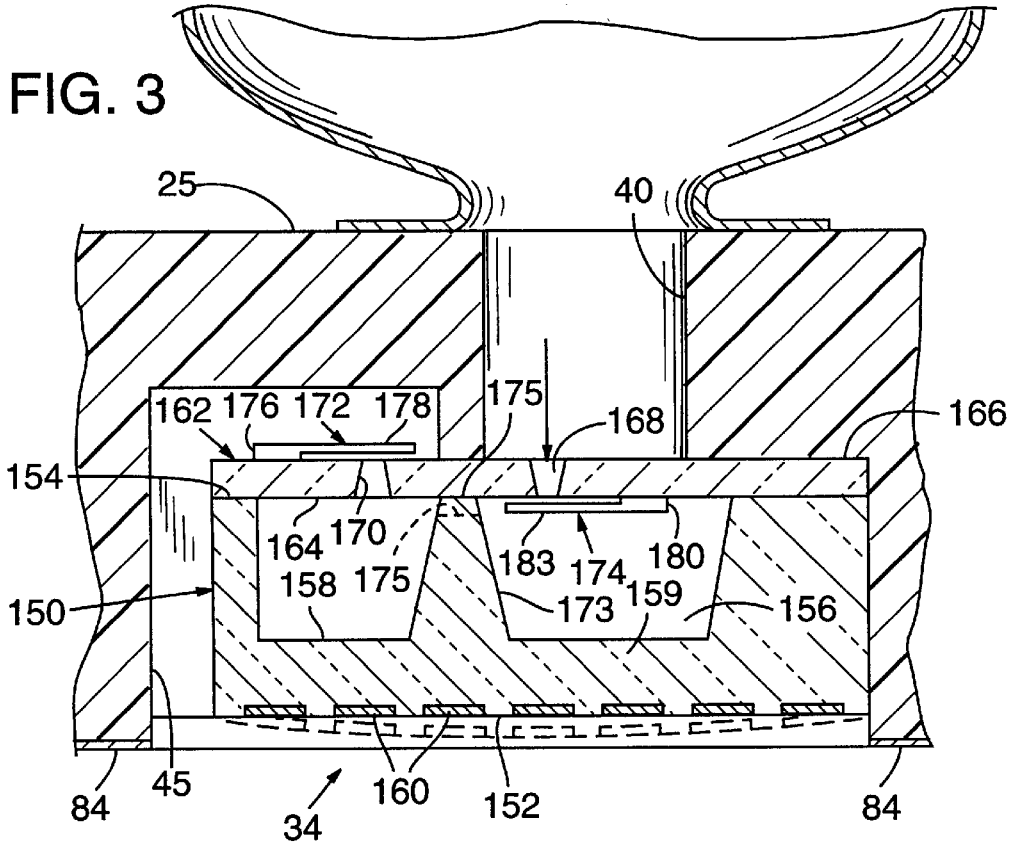
FIG. 3 is a cross-sectional view taken along lines 3—3 of FIG. 2.
Figure 4:
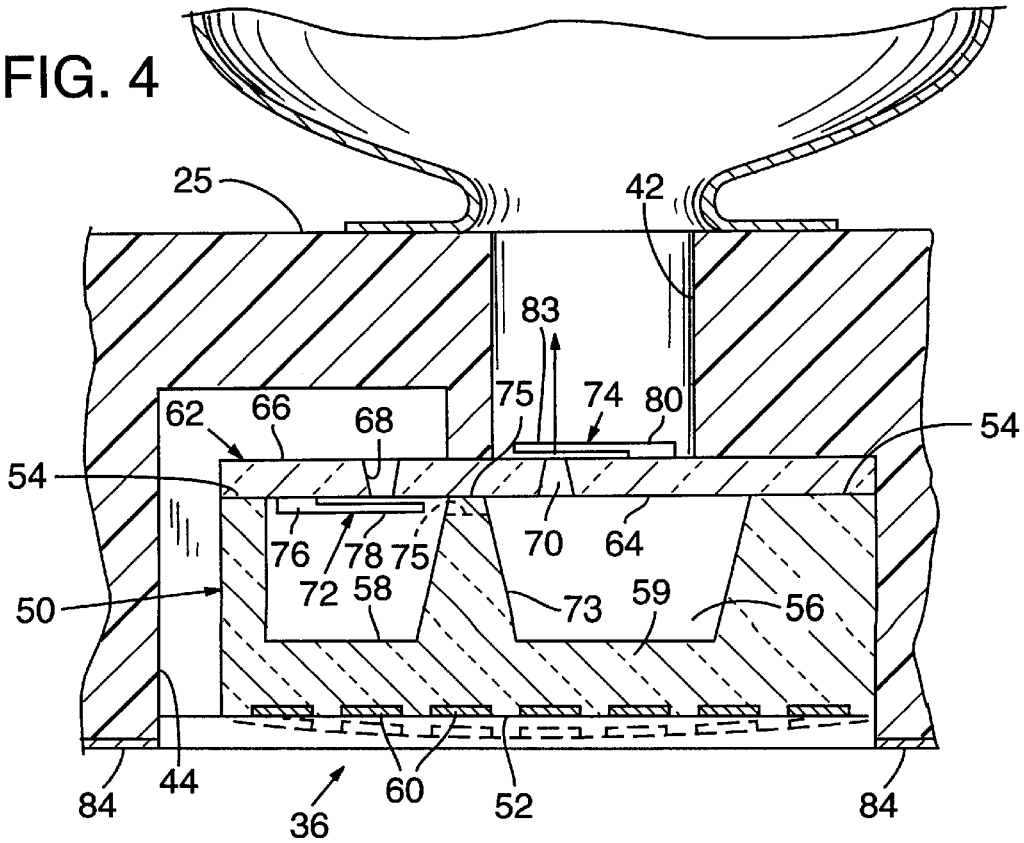
FIG. 4 is a cross-sectional view taken along line 4—4 of FIG. 2.
Figure 5:
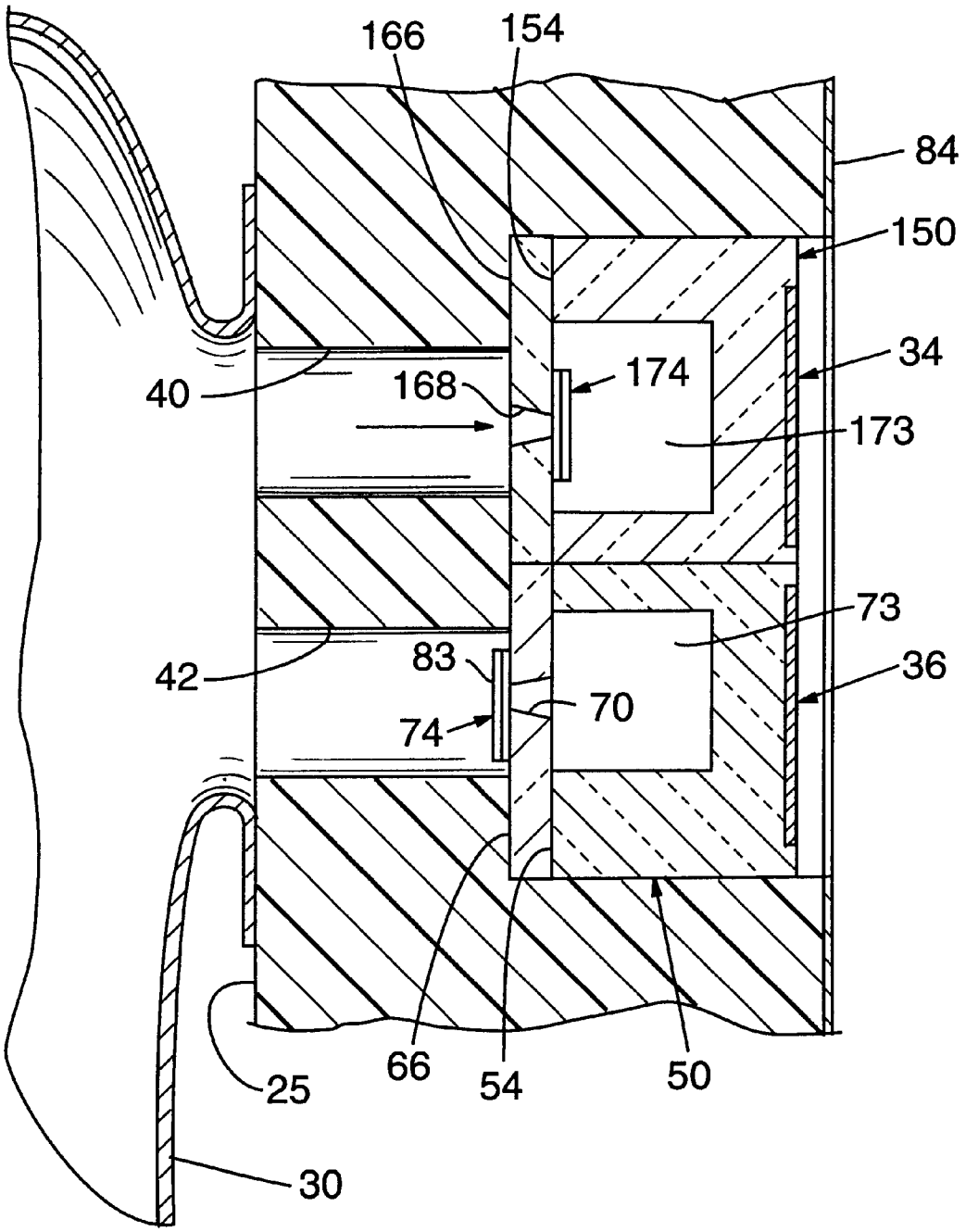
FIG. 5 is cross-sectional view taken along line 5—5 of FIG. 2.

Referring to FIGS. 3–5, the opening of the bag 30 is attached to the interior surface 25 of the plastic reservoir body so that the bag opening encloses an outlet port 40 and an inlet port 42. The spaced-apart ports 40, 42 are formed in the wall of the pen reservoir to provide fluid communication between the interior of the bag 30 and the pumps 34, 36 described more fully next.

Figure 2:
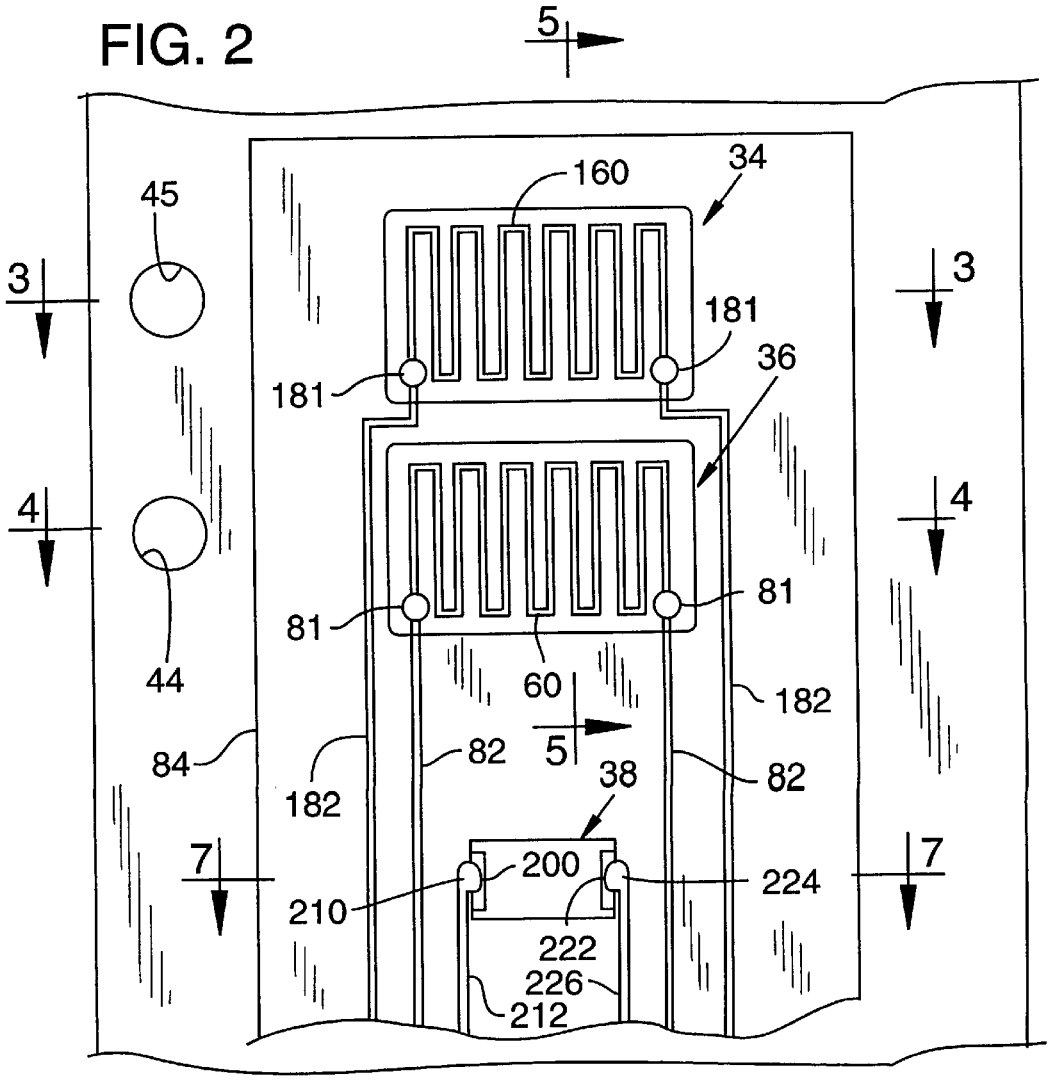
FIG. 2 is an enlarged view of a side wall of the pen to which pumping and sensing mechanisms are mounted.

With reference to FIGS. 2 and 4, the inflation pump 36 is a compact member that is fabricated using micromachining techniques and mounted within a correspondingly shaped opening formed in the outer surface of the pen wall. The inflation pump 36 is controlled by the printer microprocessor 39 for pumping ambient air from an inlet conduit 44, which is in communication with ambient air, to the inlet port 42 for inflating the bag 30. The pump may be like the one described in U.S. Pat. No. 5,129,794 assigned to the assignee of the present application and herein incorporated by reference.

In particular, the pump 36 (FIG. 4) can be characterized as a diaphragm type and comprises a first substrate member 50 having an outer planar surface 52 on one side thereof, and an inner surface 54 on the opposite side. The first substrate member 50 has a cavity 56 formed therein. Between the cavity 56 and the outer surface 52, the substrate defines a diaphragm 59. A generally serpentine-shaped resistor 60 (FIGS. 2 and 4) is embedded in the diaphragm 59 near the outer surface 52 of the substrate member. Preferably, the opening into which the pump 36 is fit is sufficiently deep so that the outer surface 52 of the substrate member is recessed slightly relative to the outermost surface of the pen body. The surface may be filled with an epoxy-based encapsulant that coats the resistors and the connection to copper traces 82.

The inflation pump 36 also comprises a second substrate member 62 having an inner planar surface 64 and an outer planar surface 66 on an opposite side thereof and generally parallel to the inner surface 64. An inlet hole 68 is formed through the second substrate member. An outlet hole 70 that is spaced from the inlet hole 68 is also formed through the substrate member 62.

The inflation pump 36 is formed to include flappers 72, 74 respectively associated with the inlet hole 68 and outlet hole 70. The flappers provide valving to control the fluid flow through the pump to be one way: from the inlet conduit 44 to the inlet port 42. One flapper 72 comprises a generally L-shaped configuration (FIG. 4) having a base portion 76 attached to the inner surface 64 of the substrate member 62. A beam portion 78 extends in cantilever fashion from the base 76 to extend over the inlet hole 68. The other flapper 74 is mounted to the outer surface 66 of the substrate member 62 and includes a base 80 that is attached to that surface 66. A cantilevered beam portion 83 extends from the base 80 to extend over the outlet hole 70.

As depicted in FIG. 4, the inner surface 54 of the first substrate member is bonded to the inner surface 64 of the second substrate member 62 to define an enclosed cavity 56 through which air may move only through inlet hole 68 and outlet hole 70.

The first substrate member 50 is formed to include a boss 73 that projects from the inner surface 58 toward to the second substrate member 62. The boss 73 has a planar face 75 that abuts the inner surface 64 of the second substrate member whenever the pump 36 is in an inactive position (shown in solid lines FIG. 4). The boss 73 bifurcates the cavity 56 to occlude the fluid path between the inlet hole 68 and outlet hole 70 whenever the pump is inactive. In effect, the boss 73 serves as a valve that is normally closed when the pump is inactive so that no air moves into or out of the bag 30 unless the pump is activated as described below.

With reference to FIG. 2, each end of the above-mentioned resistor 60 terminates in a terminal pad 81. The pad is bonded to a copper trace 82 that is part of a plastic-based flexible circuit 84 that is bonded to the pen outer surface. One such flexible circuit is described in U.S. Pat. No. 5,189,787 assigned to the assignee of the present application.

The traces 82 conduct low-voltage signals (under the control of the printer microprocessor 39) through the resistor 60. The current through the resistor heats the resistor 60 and adjacent portions of the diaphragm 59, which causes the diaphragm to expand and buckle or deflect outwardly as shown by dashed lines in FIG. 4. The current applied to the resistor 60 is thereafter instantaneously removed so that the diaphragm cools and returns to the position shown in solid lines of FIG. 4.

It will be appreciated that the deflection of the pump diaphragm 59 enlarges the cavity 56 thus drawing air from inlet conduit 44 into the inlet hole 68, while the outlet hole 70 is occluded by the flapper 74 that moves to cover the hole as a result of the pressure drop associated with the enlargement of cavity 56. The stroke of the pump 36 associated with the cooling and return of the diaphragm 59 to a flat orientation forces flapper 72 to cover and occlude the inlet hole 68 while air is pumped into the bag 30 through the outlet hole 70 of the pump. The current applied and removed from the resistor 60 is rapidly cycled to continue deflection and return of the diaphragm 59, thereby continuing to pump air into the bag.

With reference to FIGS. 2 and 3, the deflation pump 34 is also a compact member that is fabricated using micromachining techniques and mounted with a correspondingly shaped opening formed in the outer surface of the pen wall. The deflation pump 34 is controlled by the printer microprocessor 39 for pumping air out of the bag 30 via the outlet port 40 and through an outlet conduit 45 that is in communication with ambient air.

The deflation pump 34 (FIG. 3) can be characterized as a diaphragm-type and comprises a first substrate member 150 having an exterior planar surface 152 on one side thereof, and an inner surface 154 on the opposite side. The first substrate member 150 has a cavity 156 formed therein. Between the cavity 156 and the outer surface 152, the substrate defines a diaphragm 159. A generally serpentine-shaped resistor 160 (FIGS. 2 and 3) is embedded in the diaphragm 159 near the outer surface 152 of the substrate member.

The deflation pump 34 also comprises a second substrate member 162 having an inner planar surface 164 and an outer planar surface 166 on the opposite side thereof and generally parallel to the inner surface 164. An inlet hole 168 is formed through the second substrate member. An outlet hole 170 that is spaced from the inlet hole 168 is also formed through the substrate member 162.

The deflation pump 34 is formed to include flappers 172, 174 respectively associated with the outlet hole 170 and inlet hole 168 to control the flow through the pump to be one-way: from the outlet port 40 to the outlet conduit 45. One flapper 172 comprises a generally L-shaped configuration having a base portion 176 attached to the outer surface 166 of the substrate member 162. A beam portion 178 extends in cantilever fashion from the base 176 to extend over the outlet hole 170. The other flapper 174 is mounted to the inner surface 164 of the substrate member 162 and includes a base 180 that is attached to that surface 164. A cantilevered beam portion 183 extends from the base 180 to extend over the inlet hole 168.

As depicted in FIG. 3, the surface 154 of the first substrate member 150 is bonded to the inner surface 164 of a second substrate member 162 to define a cavity 156 through which air may move through inlet hole 168 and outlet hole 170.

The first substrate member 150 is formed to include a boss 173 that projects from the inner surface 158 toward to the second substrate member 162. The boss 173 has a planar face 175 that abuts the inner surface 164 of the second substrate member whenever the pump 34 is in an inactive position (shown in solid lines in FIG. 3). The boss 173 bifurcates the cavity 156 to occlude the fluid path between the inlet hole 168 and the outlet hole 170 whenever the pump is inactive. In effect, the boss 173 serves as a valve that is normally closed when the pump is inactive so that no air moves into or out of the bag 30 unless the pump is activated as described below.

With reference to FIG. 2, each end of the resistor 160 terminates in a terminal pad 181. The pad is bonded to a copper trace 182 that is part of the flexible circuit 84. The traces 182 conduct low-voltage signals through the resistor 160. The current through the resistor heats the resistor 160 and adjacent portions of the diaphragm 159, which causes the diaphragm to expand and buckle or deflect outwardly as shown by dashed lines in FIG. 3. The current applied to the resistor 160 is thereafter instaneously removed by the microprocessor so that the diaphragm cools and returns to the position shown in solid lines of FIG. 3.

The deflection of the pump diaphragm 159 enlarges the cavity 156, thus drawing air from the bag interior through the inlet hole 168, while the outlet hole 170 is occluded by the flapper 172 that moves to cover the hole 170 as a result of the pressure drop associated with the enlargement of the cavity 156. The stroke of the pump 34 associated with the cooling and return of the diaphragm 159 to a flat orientation forces flapper 174 to cover and occlude the inlet hole 168 while air is pumped out through the outlet conduit 45. The current applied and removed from the resistor is rapidly cycled to repeat the deflection and return of the diaphragm 159, thereby continuing to pump air out of the bag.

By way of example, a method of fabricating the deflation pump 34 is next described with reference to FIGS. 6*a*–6*r*. It will be appreciated that the same fabrication method would be applied to the inflation pump 36. For the purpose of this application, the term micromachining is intended to include material deposition, etching and bonding procedures as described below.

Figure 6A:
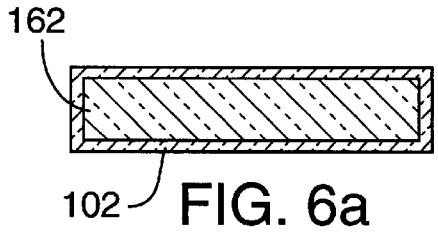
FIGS. 6*a* through 6*r* are section diagrams depicting fabrication of pump components of the present invention.
Figure 6B:
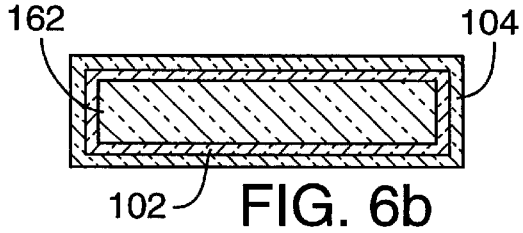

The substrate member 162 is shown in cross-section in FIG. 6*a* prior to processing. The substrate member 162, which may be a silicon substrate member 400 microns thick, includes a first coating layer 102, which may be a 0.1 micron thick silicon dioxide layer. Next, a second coating layer 104, for example a polysilicon coating, is deposited over the first coating by a chemical vapor deposition technique well known in the art, FIG. 6*b*. Coating layer 104 may be 2 microns thick.

Figure 6C:
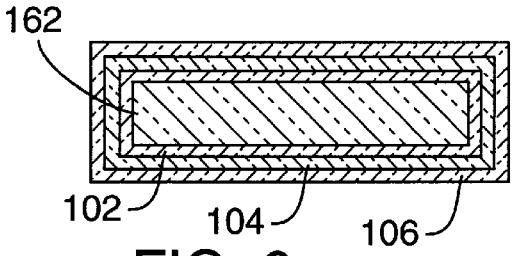

The next step illustrated by FIG. 6*c* is to apply a third coating 106 over the second coating 104. A third coating may be a 0.2 micron thick LPCVD (low pressure chemical vapor deposition) silicon nitride layer which is applied by conventional LPCVD techniques.

Figure 6D:
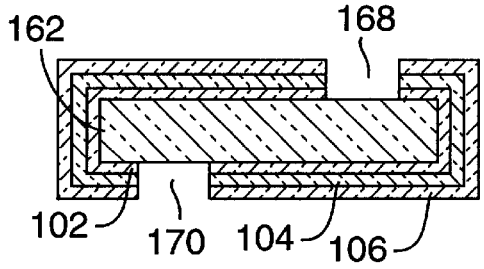

Next, holes 170, 168 extending through the three coating layers 102, 104, 106 are patterned and etched on opposite sides of the substrate assembly. The holes may be etched with a carbon tetrafluoride ($CF_4$), FIG. 6*d*.

Figure 6E:
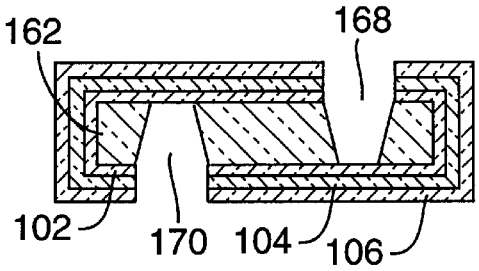

Holes 170, 168 are then extended through the substrate member 162 as by etching with potassium hydroxide/isopropanol/water (KOH/ISO/$H_2O$) as shown in FIG. 6*e*.

Figure 6F:
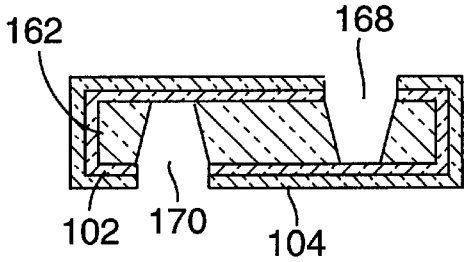

Next, as shown in FIG. 6*f*, the third layer 106 is stripped by using phosphoric acid ($H_3PO_4$).

Figure 6G:
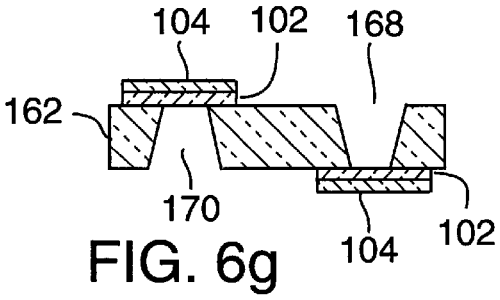
Figure 6H:
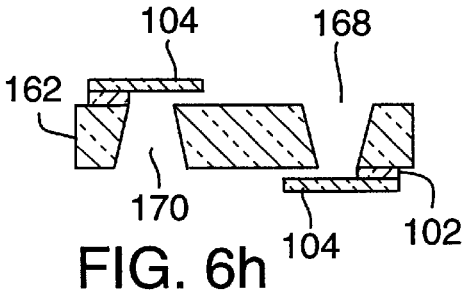
Figure 6I:
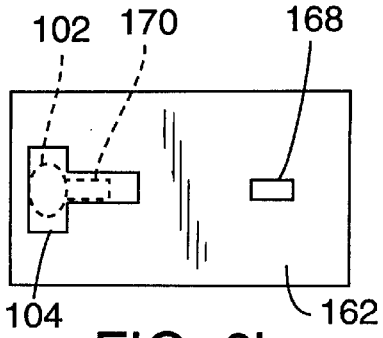
Figure 6J:
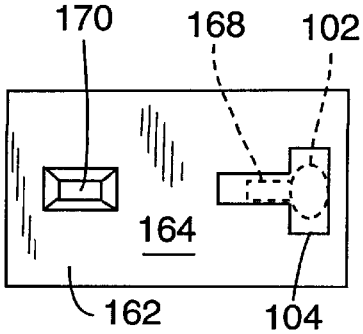

The portion of the assembly which will become the flappers of the deflation pump is next patterned and etched by using $CF_4$. Initially, as shown in FIG. 6*g*, the etching material removes all of the first and second layers 102, 104 except for masked portions that appear as T-shaped in the top plan view of FIG. 6*i*. As a second step in this etching operation, the etching solution is allowed to remain in contact with the surface of substrate 162 and the perimeter surface of layer 102, thus causing etching of layer 102 to continue as illustrated in FIGS. 6*h*–6*j* (FIG. 6*i* is a top plan view, FIG. 6*j* is a bottom plan view). This perimeter etching of layer 102 causes it to be removed from below the overlying third layer 104 so as to expose holes 170, and 168. When this perimeter etching of layer 102 has progressed to the point indicated in FIGS. 6*h*–6*j*, it is terminated by removal of etching solution, thus providing the processed substrate 162 shown in FIG. 3.

Figure 6K:
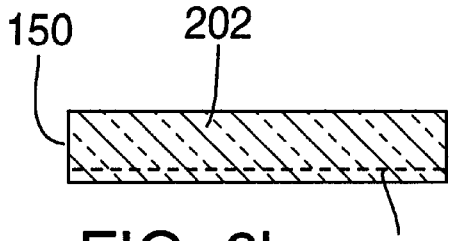
Figure 6L:
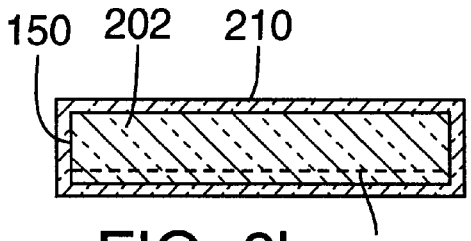

A substrate member 150 is shown in cross-section of FIG. 6*k* prior to processing. Substrate member 150 may be a 400 micron-thick silicon substrate having a 385 micron-thick heavily doped (for example, $10^{18}$ atoms/$cm^3$ phosphorous doped) upper portion 202 in a 15 micron-thick lightly doped (e.g., $10^{16}$ atoms/$cm^3$ phosphorous doped) lower region 204 which may be provided by a conventional epitaxy process known in the art.

A first coating layer 210 (FIG. 61) is applied to the substrate 150. The layer may be a 0.2 micron-thick layer of LPCVD silicon nitride ($Si_3N_4$).

Figure 6M:
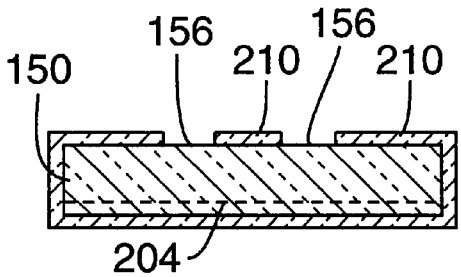

As illustrated in FIG. 6*m*, cavity 156 is patterned and etched in the first layer 210 on the top of the assembly $CF_4$ plasma etching.

Figure 6N:
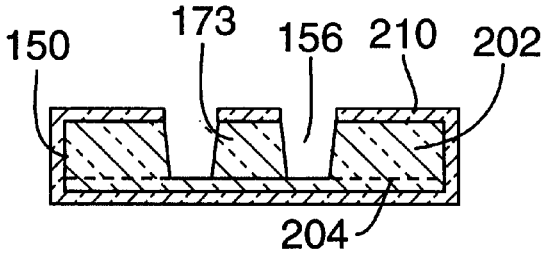

Next, FIG. 6*n*, cavity 156 is extended through the first portion 202 of substrate 200 as by etching the exposed surface thereof with a 1:3:8 solution of hydrofluoric acid, nitric acid and acetic acid. The pattern of the cavity defines the boss 173.

Figure 6O:
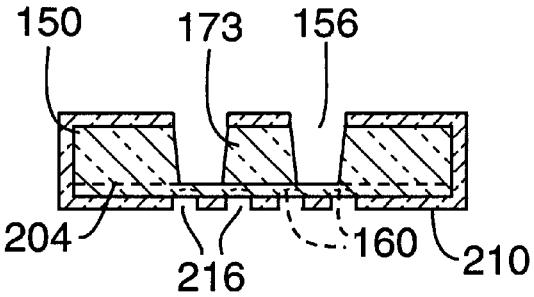

The serpentine pattern 216 corresponding in shape to resistor element 160 in FIG. 1, is then etched in the first layer 210 on the bottom side of the substrate by using $CF_4$ plasma etching as illustrated in FIG. 6*o*.

Next, as illustrated in dashed lines in FIG. 6*o*, resistors 160, (e.g., phosphorous resistors) are implanted in the lightly doped portion 204 of the substrate and the surface thereof exposed by the serpentine pattern etched in layer 210. The resistor implant may be formed using the technique of ion implantation which is well known in the art. The resistor pattern provided may have a resistance of, for example, 1,000 ohms.

Figure 6P:
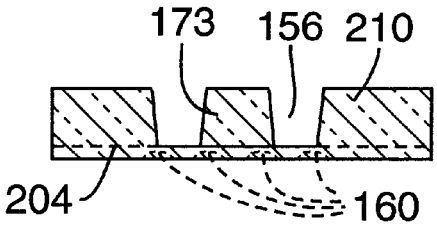

Next, the remaining portion of coating layer 210 is stripped away using $H_3PO_4$, FIG. 6*p*.

Figure 6Q:
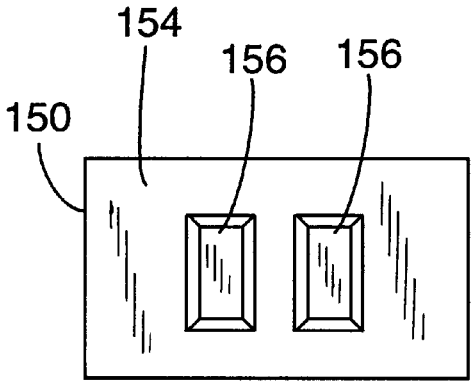
Figure 6R:
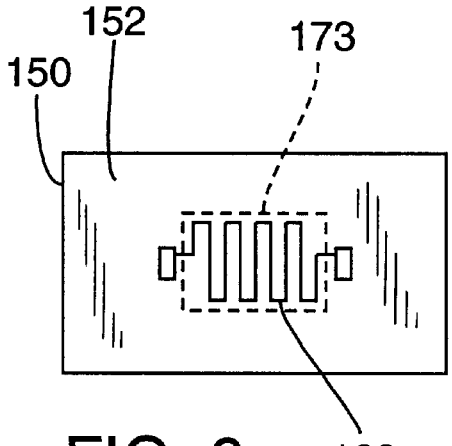

FIGS. 6*q* and 6*r* are respectively top and bottom plan views of FIG. 6*p* showing the cavity 156 and resistor 160 configurations provided in substrate 150.

The top surface 154 of substrate 150 shown in FIG. 6*q* is then positioned in contact with the bottom surface 164 of substrate 162 shown in FIG. 6*j*, and the two substrates are bonded together as by silicon/silicon fusion bonding to provide the assembled deflation pump 34.

Preferably, the back pressure level within the reservoir 24 is maintained at a constant level during operation of the pen. To this end, the microprocessor 39 (see FIG. 8) applies the appropriate low-voltage signals to operate the inflation pump 36 and deflation pump 34 as necessary to maintain the back pressure. In a preferred embodiment of the invention, the accumulator system employs pressure transducers for providing to the microprocessor information that is indicative of the pressure inside of the reservoir and of the ambient air pressure. The microprocessor then determines the difference between these two pressures (that is, the differential pressure value), and, via inflation pump 36 or deflation pump 34, inflates or deflates the bag 30 so that the differential pressure value (hence, the back pressure within the reservoir) remains constant, or at least within an acceptable range.

The pressure transducer 38 employed for monitoring the pressure inside the pen reservoir 24 is a minute component, preferably formed by micro-machining techniques, such as described above in connection with the inflation and deflation pumps. Specifically, with reference to FIGS. 2 and 7, the pressure transducer 38 may be of the capacitive type, including a glass base 200. The base 200 fits within a countersunk opening formed through the wall of the pen and is bonded at its edges to the pen wall. The base has an inner surface 202, across part of which a thin metallization layer or capacitor plate 204 is deposited. A conductive cap 206 is bonded to the edge of the base 200 to provide a continuous conductive path from the plate 204 to the outer surface 208 of the base 200.

Figure 7:
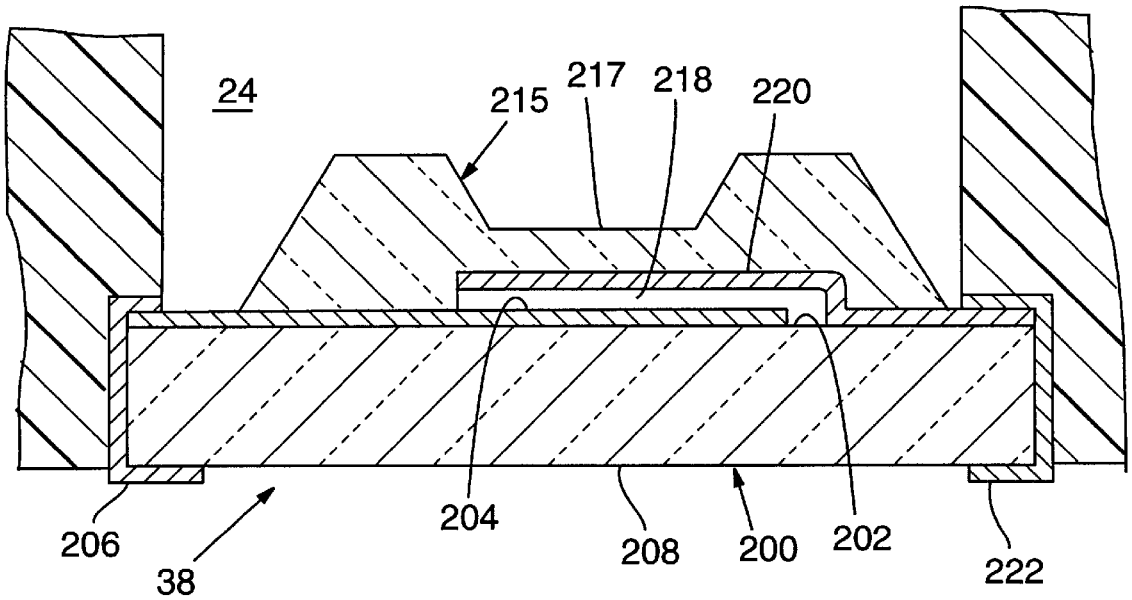
FIG. 7 is a cross-sectional view taken along line 7—7 of FIG. 2.

At the outer surface 208 of the base 200, the conductor 206 is bonded at pad 210 to a conductive trace 212 (FIG. 2), carried on the flexible circuit 84 described above. A silicon die 215 etched to have a thin (approximately 25 micron) diaphragm 217 is electrostatically bonded to the surface 202 of the glass plate 200. The diaphragm 217 is spaced from the surface 202, thereby to define in the surface of the diaphragm a sealed cavity 218. The cavity-facing side of the diaphragm 217 has a metallization layer or plate 220 deposited thereon to form the second capacitor plate. That plate 220 terminates at a conductive cap 222 that provides a conductive path to the outer surface 208 of the base 200 (FIG. 7). At conductive pad 224 (see FIG. 2), connection of the plate 220 is made with a conductive trace 226 on a flexible circuit 84, that trace leading to the microprocessor 39.

The cavity 218 is sealed to establish a constant reference pressure therein. As the back pressure level within the pen reservoir 24 changes (relative to the reference pressure in cavity 218), the diaphragm 217 will deflect, thereby changing the spacing between the two capacitor plates 204, 220, which, in turn, changes the capacitance of the transducer 38 as measured by the microprocessor. The capacitance of the transducer 38 is readily correlated to a back pressure level within the pen.

Any suitable pressure transducer 41 may be employed for providing to the microprocessor a signal indicative of the ambient air pressure. The microprocessor 39 then compares the ambient and pen reservoir pressures to calculate a differential pressure value and, if necessary, operates the inflation pump 36 or deflation pump 34 for adjusting the pen back pressure as explained above.

It is contemplated that the cavity 218 of the transducer 38 could be placed in communication with ambient (e.g., via an aperture through base 200), thereby permitting the transducer to provide the above-noted differential pressure signal while eliminating the need for the second transducer 41.

In a preferred embodiment, the microprocessor responds to a power-down signal (i.e., a signal indicative of when the printer power is turned off) by discharging an internal battery or capacitor and directing the discharged voltage to the deflation pump 34 so that the bag will deflate. Accordingly, the back pressure is significantly increased whenever the printer is turned off. Consequently, the print head of the inactive pen is less likely to leak as a result of vibration or extreme environmental changes that occur while the printer is off.

The foregoing has been described in connection with preferred and alternative embodiments. It will be appreciated by one of ordinary skill in the art, however, that various modifications and variations may be substituted for the mechanisms and method described here while the invention remains defined by the appended claims and their equivalents. For example, even through the pumps 34, 36 have been described as two discrete components, the functions of those pumps could be carried out with an appropriately valved single pump. Moreover, a reversible pump, such as a rotary type, could provide both the inflation and deflation functions. Further, since the print head may be of the type micromachined from components that include a silicon substrate, the pumps and/or transducers could be manufactured with and remain part of the print head with the ambient air inlet and outlet conduits extended as necessary to reach the bag.

What is claimed is:

1. An accumulator system for an ink-jet printer pen that has a reservoir, wherein a portion of the reservoir defines a volume for storing ink, the system comprising:

a bag carried within the pen reservoir, the bag being inflatable so that the volume displaced by the bag within the reservoir volume is changeable; and a first pump mounted to the pen and connected to the reservoir and in fluid communication with the bag and selectively operable for actively pumping fluid into the bag, thereby to regulate a back pressure in the reservoir.

2. The system of claim 1 wherein the pen reservoir includes an inlet and an outlet being located to be enclosed on one side by the bag.

3. The system of claim 2 wherein the first pump is connected to and is in fluid communication with the reservoir inlet.

4. The system of claim 3 including a first flapper valve positioned intermediate the inlet and the first pump for preventing fluid flow from the bag into the first pump.

5. The system of claim 3 including a second pump connected to the outlet of the reservoir, the second pump being selectively operable for actively pumping fluid out of the bag.

6. The system of claim 5 wherein the second pump is connected to and is in fluid communication with the reservoir outlet.

7. The system of claim 6 including a second flapper valve positioned intermediate the outlet and the second pump for preventing fluid flow from the second pump into the bag.

8. The system of claim 5 wherein the second pump is carried on the pen.

9. The system of claim 1 wherein the first pump includes a movable diaphragm that is actuated to move by cyclic heating and cooling of the diaphram.

10. The system of claim 1 further comprising conductive members mounted to the pen for directing electrical signals to the first pump for operating the first pump for pumping fluid into the bag.

11. The system of claim 1 wherein the first pump is constructed with micromachined components.

12. The system of claim 11 wherein the micromachined components include a diaphragm and flapper valves.

13. The system of claim 1 further comprising a first pressure transducer carried by the pen and providing signals indicative of the pressure inside the pen reservoir.

14. The system of claim 13 wherein the first pump and the second pump are activated in response to the signals provided by the first pressure transducer.

15. The system of claim 13 wherein the first pressure transducer is mounted to the wall of the pen.

16. The system of claim 13 further comprising a second transducer associated with the printer and for providing a signal that is indicative of ambient pressure, thereby to permit comparison of the pressure inside the pen reservoir with ambient pressure.

17. The system of claim 1 wherein the pump includes a resistor for activating the pump.

18. The system of claim 1 including a microprocessor for providing signals to the first pump, wherein the first pump is activated in response to the signals.

19. A method of controlling the back pressure within an ink-jet pen reservoir, comprising the steps of:

mounting an inflatable bag within the pen reservoir;

connecting a pump to the inflatable bag; and utilizing the pump to actively pump fluid into and out of the bag to maintain the back pressure in the pen reservoir at a preselected pressure level.

20. The method of claim 19 further comprising the steps of mounting to the pen a first pump for actively pumping fluid into and out of the bag; and valving the first pump for selectively preventing fluid movement into or out of the bag.

21. The method of claim 20 further comprising the step of mounting a second pump to the pen, the first pump actively pumping air into the bag and the second pump actively pumping air out of the bag.

22. The method of claim 21 further comprising the steps of:

mounting a first flapper valve to the first pump for preventing fluid flow from the bag into the first pump; and mounting a second flapper valve to the second pump for preventing fluid flow from the second pump into the bag.

23. The method of claim 20 further comprising the step of mounting to the pen a pressure transducer for monitoring the pressure within the reservoir.

24. The method of claim 19 wherein the pen is operable with a printer that can be switched on and off, the method including the step of pumping fluid from the bag whenever the printer is turned off.

25. A method of manufacturing an ink-jet pen with an accumulator system, comprising the steps of:

providing a reservoir volume;

mounting within the reservoir volume a bag that is inflatable so that the volume displaced by the bag within the reservoir volume is changeable; and mounting to the pen a pump that is selectively operable for actively pumping fluid into the bag, thereby to regulate a back pressure in the reservoir.

26. The method of claim 25 including the step of providing a micromachined pump for mounting to the pen.

27. The method of claim 26 further comprising the steps of providing a first pressure transducer for monitoring the pressure within the reservoir and providing a first signal indicative of the pressure inside the pen reservoir.

28. The method of claim 27 further comprising the step of activating and the pump in response to the first signal provided by the first pressure transducer.

29. The method of claim 28 further comprising the steps of:

providing a second pressure transducer and providing a second signal that is indicative of ambient pressure; and comparing the pressure inside the pen reservoir with the ambient pressure.

* * * * *